US007079087B2

(12) United States Patent
Bateman et al.

(10) Patent No.: US 7,079,087 B2
(45) Date of Patent: Jul. 18, 2006

(54) ANTENNA JOINT CONNECTOR

(75) Inventors: Blaine Rexel Bateman, Louisville, CO (US); Richard Loffler, Surrey (GB); Randy Bancroft, Denver, CO (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 1 day.

(21) Appl. No.: 10/952,030

(22) Filed: Sep. 27, 2004

(65) Prior Publication Data

US 2006/0066501 A1 Mar. 30, 2006

(51) Int. Cl.
*H01Q 1/50* (2006.01)

(52) U.S. Cl. ..... 343/906; 343/905; 439/578

(58) Field of Classification Search ..... 343/830, 343/904, 905, 906; 439/578
See application file for complete search history.

(56) References Cited

U.S. PATENT DOCUMENTS 3,740,453 A * 6/1973 Callaghan et al. ..... 174/75 C
4,523,197 A * 6/1985 Imazeki et al. ..... 343/702
5,340,332 A * 8/1994 Nakajima et al. ..... 439/584
6,217,380 B1 * 4/2001 Nelson et al. ..... 439/578
6,655,991 B1 * 12/2003 Heebe et al. ..... 439/578

OTHER PUBLICATIONS

International Searching Authority "Notification of Transmittal of the International Search Report and the Written Opinion of the International Searching Authority, or the Declaration" Dec. 8, 2005.

* cited by examiner

*Primary Examiner*—Shih-Chao Chen
(74) *Attorney, Agent, or Firm*—Holland & Hart LLP

(57) ABSTRACT

To attain the advantages of and in accordance with the purpose of the present invention, a connector for an antenna is provided. The connector comprises a nut, insulator, contact pin, sleeve, and a captive housing. The connector is such that the housing can be positioned and angled relatively to a radio frequency device as desired and then locked in place by tightening the nut (or interface) on the device.

18 Claims, 3 Drawing Sheets

ANTENNA JOINT CONNECTOR

FIELD OF THE INVENTION

The present invention relates to antennas and, more particularly, a connector to attach antennas to devices.

BACKGROUND OF THE INVENTION

Many antennas today are externally connected to a device. These conventional connectors are typically free spinning and held in place by a washer and adaptor. The adaptor is snapped into the housing. As those of skill in the art know, the conventional connector is expensive and difficult to manufacture, assemble, and use. Thus, it would be desirous to provide an improved antenna connector.

SUMMARY OF THE INVENTION

To attain the advantages of and in accordance with the purpose of the present invention, a connector for an antenna is provided. The connector comprises a nut, insulator, contact pin, sleeve, and a captive housing.

The foregoing and other features, utilities and advantages of the invention will be apparent from the following more particular description of a preferred embodiment of the invention as illustrated in the accompanying drawings.

BRIEF DESCRIPTION OF THE DRAWING

The above and other objects and advantages of the present invention will be apparent upon consideration of the following detailed description, taken in conjunction with the accompanying drawings, in which like reference characters refer to like parts throughout, and in which.

DETAILED DESCRIPTION

The present invention will now be described with reference to FIGS. 1 to 5. While the present invention is described with reference to a conventional antenna, one of ordinary skill in the art would now recognize many antenna designs could be used with the present connector including, for example, a dipole antenna, a multi-band PCB antenna, a planar antenna (directional or omni-directional), or the like. Generally, the connector is useful with an elbow style, such as, when a 90 degree connection is necessary or desired, although the connector is useful with any angle of connection.

Figure 1:
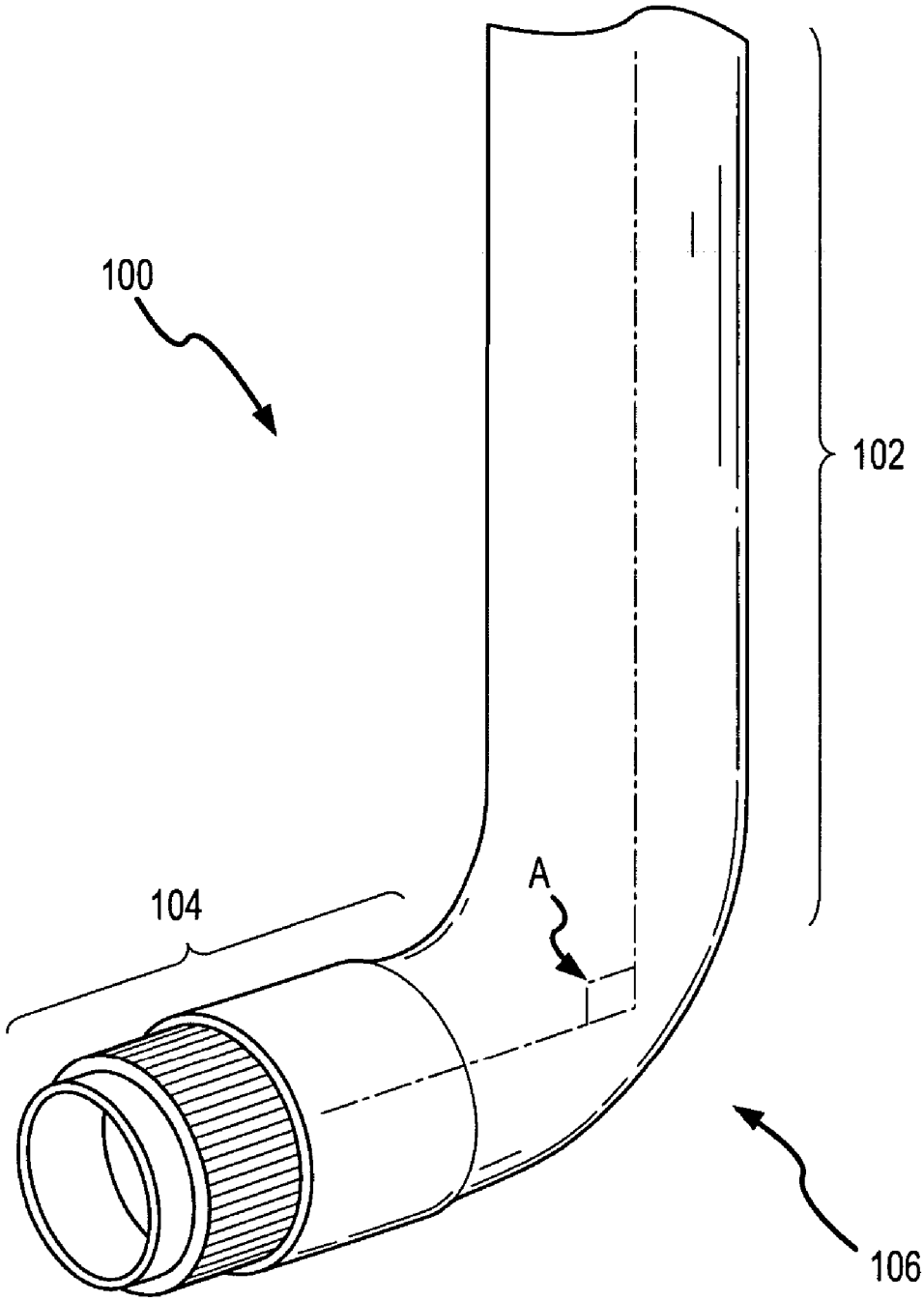
FIG. 1 is a perspective view of an antenna having a connector consistent with an embodiment of the present invention.

Referring now to FIG. 1, an antenna 100 consistent with an embodiment of the present invention is shown. Antenna 100 includes a radiating portion 102 and a connector portion 104. Antenna 100 includes an elbow 106 between radiating portion 102 and connector portion 104. While elbow 106 is shown at an angle A of 90 degrees, other angles are of course possible ranging from zero degrees to a radiating portion 102 bent back over connector portion 104 or an angle about 180 degrees.

Figure 2:
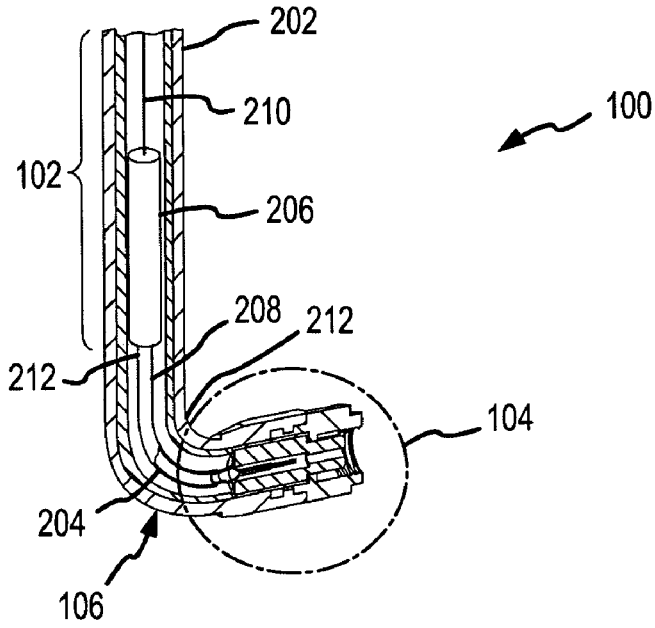
FIG. 2 is a cross-section of the antenna shown in FIG. 1.

Referring now to FIG. 2, a cross-section of antenna 100 including radiating portion 102, connector portion 104, and elbow 106 is shown in more detail. Antenna 100 includes a housing 202 about radiating portion 102, elbow 106, and connector portion 104. Radiating portion 102 includes housing 202, a coaxial cable 204, and a counterpoise 206. Coaxial cable 204 includes at least an outer jacket 208 and a central conductor 210. Coaxial cable 204 may be held in place by brackets 212 placed in housing 202.

Figure 3:
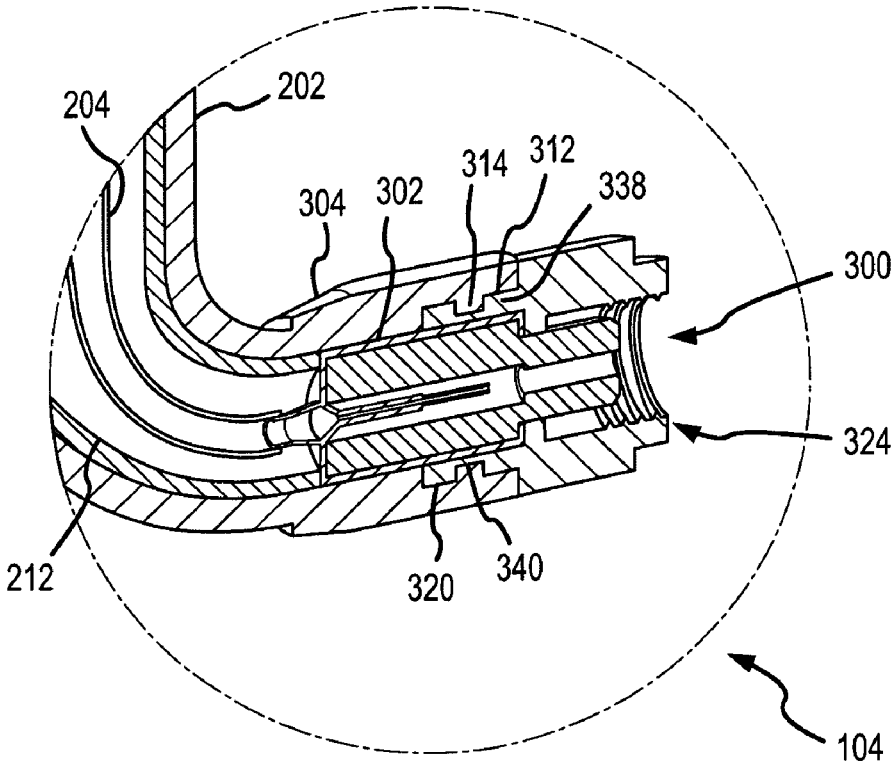
FIG. 3 is a blow up of the cross-section of the connector portion of FIG. 2.
Figure 4:
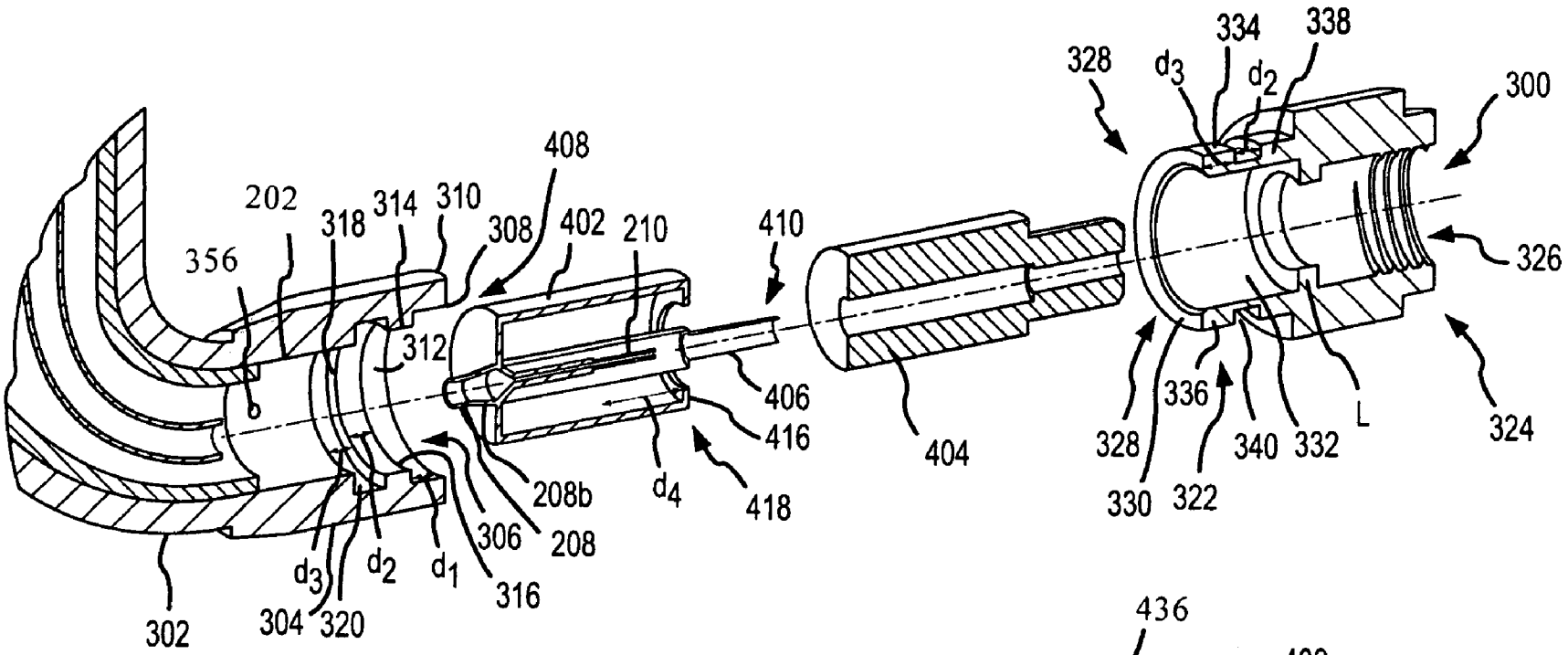
FIG. 4 is an exploded view of FIG. 3.

Referring now to FIGS. 3 and 4, an enlarged cross-section of connector 104 is shown. FIG. 4 is consistent with FIG. 3, but shown in an exploded view for ease of reference. Connector 104 comprises a portion of housing 202. Housing 202 has an inner surface 302 and an outer surface 304. Housing 202 has an opening 306 defined by an inner surface edge 308 and an outer surface edge 310. Extending from inner surface edge 308 is a recess 312. Recess 312 extends a distance d1 to a protrusion 314 having a recess side 316 and a channel side 318 opposite recess side 316. Recess side 316 and channel side 318 are a distance d2 apart. A channel 320 resides substantially adjacent channel side 318 of protrusion 314. Channel 320 has a width d3. While the present invention refers to channels and protrusions, other types of engaging elements could be used, such as, for example, grooves, ribs, bearing surfaces, or the like.

Connector 104 also includes a RP-SMA interface 300 having a proximate end 322 that fits in opening 306 and a distal end 324 that is connectable to an RF device, such as, a wireless gateway. Although shown with threads 326, the interface 300 could be any desired RF connector interface, as one of ordinary skill in the art would recognize on reading the disclosure. Proximate end 322 has an opening 328 defined by a proximate end edge 330. Proximate end 322 also has an inner wall 332 and an outer wall 334. Outer wall 334 has a first protrusion 336 substantially adjacent edge 330 and a second protrusion 338 a distance d2 from first protrusion 336. First protrusion 336 has a width d3, corresponding to channel 320. First protrusion 336 and second protrusion 338 define a proximate end channel 340. As can be seen from FIG. 3, first protrusion 336 resides in channel 320, protrusion 314 resides in channel 340, and second protrusion 338 resides in recess 312.

As arranged, interface 300 can freely rotate in housing 202. The rotation is guided by the above identified protrusions, channels, and recess. When locked, a frictional engagement is formed between housing 202, the ribs, and channels to inhibit rotation, as will be explained in more detail below.

As best seen in FIG. 4, the radiating element is connected to an inner sleeve 402 that resides within connector portion 104. In the case of the coaxial radiating element, outer jacket 208 is connected to sleeve 402. Central conductor 210 extends through an insulator 404 separating conductor 210 from sleeve 402. While the connection between outer jacket 208 and sleeve 402 can be made using a number of conventional techniques, it is envisioned that braids **208*b* of the outer jacket 208 would be frictionally engaged between the abutment of sleeve 402 and insulator 404. Further, a central conductor 210 would be crimped to a conducting pin 406 at proximate end 408 and extend through insulating material 404. While not shown, conducting pin 406 would be designed to attach to a corresponding connector on the device (not shown) at a distal end 410** thereof.

Figure 5:
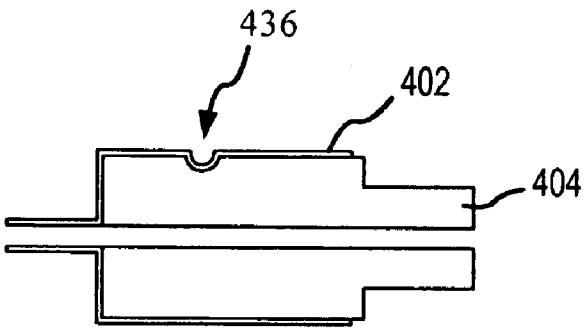
FIG. 5 shows a cross-section of a sleeve and an insulator for FIGS. 3 and 4 in more detail.

Sleeve 402 also has a terminating edge 416 at a distal end 418 thereof. Terminating edge 416 is positioned such that terminating edge 416 engages lip L when the connector is assembled. As best seen in FIG. 5, at least one dimple 436, divot, groove, or the like is formed on sleeve 402 and insulator 404. The at least one dimple 436 engages at least one protrusion 356 on inner surface 302. Protrusion 356 engages dimple 436 so that sleeve 402, insulator 404, and housing 202 cannot rotate with respect to each other. Further, pin 406 connected to insulator 404 cannot rotate with respect to insulator 404 and cannot, therefore, rotate with respect to housing 202 either. Thus, when RP-SMA interface 300 rotates, as explained below, antenna is not strained, twisted, or the like.

When unconnected to a device, interface 300 spins as described above. When tightened onto a device, such as a wireless gateway, force is applied to insulator 404 and transmitted to sleeve 402. This force is further transmitted to housing 202 by contact between sleeve 402 proximate end 408 to housing 202. This force serves to push housing 202 opposite the direction of tightening of RP-SMA interface 300, causing a resisting force to be transmitted from housing 202 to interface 300 via ribs and channels 320, 318, 314, 336, and 340. This resisting force causes friction between housing 202 and interface 300, such that when interface 300 is fully tightened, housing 202 no longer freely rotates relative to interface 300. In this manner, housing 202 can be positioned at any relative angle as desired then locked into place.

While the invention has been particularly shown and described with reference to an embodiment thereof, it will be understood by those skilled in the art that various other changes in the form and details may be made without departing from the spirit and scope of the invention.

We claim:

1. A connector for an antenna, comprising:

a housing for an antenna, the housing comprising an inner surface and a outer surface;

a housing opening defined by an inner surface edge;

the inner surface having at least one inner surface engaging element;

an interface;

the interface having a proximate end and a distal end, the distal end to connect to a radio frequency device;

the proximate end having an outer wall and an inner wall;

the outer wall having at least one outer wall engaging element corresponding to the at least one inner surface engaging element;

the housing and the interface being rotatably coupled by the at least one inner surface engaging element and the at least one outer wall engaging element;

an inner sleeve;

an insulator residing in the inner sleeve;

at least one dimple extends between the inner sleeve and the insulator; and at least one rotation protrusion is coupled to the inner surface and engages the at least one dimple, the at least one rotation protrusion and at least one dimple cause the housing, the inner sleeve, and the insulator to rotate in unison.

2. The connector according to claim 1, wherein the at least one inner surface engaging element comprises at least one channel; and the at least one outer wall engaging element comprises at least one protrusion designed to fit in the at least one channel.

3. The connector according to claim 2, wherein the at least one inner surface engaging element further comprises at least one inner surface protrusion and at least one recess; and the at least one outer wall engaging element comprises at least another protrusion and an outer wall channel, such that the at least one inner surface protrusion is designed to fit in the at least one outer wall channel and the at least another protrusion is designed to fit in the at least one recess.

4. The connector according to claim 1, wherein the at least one inner surface engaging element comprises at least one protrusion; and the at least one outer wall engaging element comprises at least one channel designed to fit in the at least one protrusion.

5. The connector according to claim 1, wherein the at least one inner surface engaging element is selected from a group of elements consisting of a channel, a protrusion, a rib, a groove, and a bearing; and the at least one outer wall engaging element is designed to rotatably mate with the at least one inner surface engaging element and is selected from a group of elements consisting of a channel, a protrusion, a rib, a groove, and a bearing.

6. The connector according to claim 1, further comprising a radiating portion residing in the housing.

7. The connector according to claim 6, further comprising:

a conductive pin residing in the insulator;

wherein the radiating portion comprises a coaxial cable radiating element, such that an outer jacket of the coaxial cable is connected to the inner sleeve; and a central conductor of the coaxial cable is connected to the conductive pin, and the conductive pin is connectable to the radio frequency device.

8. The connector according to 6 wherein the radiating portion and the housing can be angled and positioned with respect to the radio frequency device.

9. The connector according to claim 8, wherein the interface and the housing can be tightened such that the radiating portion and the housing are locked into a position relative to the radio frequency device.

10. A connector for an antenna, comprising:

a housing for an antenna, the housing comprising an inner surface and a outer surface, the inner surface having at least one anti-rotation protrusion;

a housing opening defined by an inner surface edge;

a conductive sleeve residing in the housing opening and adjacent the inner surface;

an insulator residing in the conductive sleeve;

at least one anti-rotation detent coupling the conductive sleeve and the insulator causing the conductive sleeve and the insulator to rotation substantially in unison;

the at least one anti-rotation protrusion shaped to cooperatively engage the at least one anti-rotation detent to cause the housing, conductive sleeve and the insulator to rotate substantially in unison;

an interface;

the interface having a proximate end and a distal end, the distal end to connect to a device;

the proximate end having an outer wall and an inner wall;

means for rotatably coupling the interface and the housing together residing on the outer wall and the inner surface, whereby the interface rotatable with respect to the housing and when tightened the housing is locked in a position relative to the device.

11. The connector according to claim 10, wherein the means for rotatably coupling the interface and the housing comprises:

at least one protrusion on the inner surface; and at least one channel on the outer wall, such that the at least one protrusion resides in the at least one channel.

12. The connector according to claim 10, wherein the means for rotatably coupling the interface and the housing comprises:

at least one protrusion on the outer wall; and at least one channel on the inner surface, such that the at least one protrusion resides in the at least one channel.

13. The connector according to claim 10 comprising at least one radiating portion extending from the insulator to the housing and being operatively coupled to the device.

14. A connector for an antenna, comprising:

a housing for an antenna, the housing comprising an inner surface and a outer surface;

a housing opening defined by an inner surface edge;

a first engagement device coupled to the inner surface;

a conductive sleeve residing in the housing opening and adjacent the inner surface;

an insulator residing in the conductive sleeve;

means for causing rotation of the housing, the conductive sleeve, and the insulator to occur substantially in unison, the means for causing rotation comprising a member extending from the housing to the insulator;

an interface;

the interface having a proximate end and a distal end, the distal end to connect to a radio frequency device;

the proximate end having an outer wall and an inner wall;

a second engagement device coupled to the outer wall;

the first engagement device and the second engagement device cooperatively shaped to rotatably couple the housing and the interface, whereby the interface is rotatable with respect to the housing and when tightened the housing is locked in a position relative to the radio frequency device.

15. The connector according to claim 14, wherein the member comprises a protrusion cooperatively engaged in a detent.

16. The connector according to claim 14, wherein the first engagement device comprises at least one protrusion and the second engagement device comprises at least one channel.

17. The connector according to claim 14, wherein the second engagement device comprises at least one protrusion and the first engagement device comprises at least one channel.

18. The connector according to claim 14, wherein the first engagement device and the second engagement device are selected from a group of engagement devices consisting of protrusions, dimples, ridges, channels, grooves, and detents.

* * * * *